US005883065A

United States Patent [19]

Swift, II et al.

[11] Patent Number: 5,883,065

[45] **Date of Patent: *Mar. 16, 1999**

[54] PHASE SEPARATED DETERGENT COMPOSITION

[75] Inventors: Ronald A. Swift, II, West Chester, Ohio; Stephen W. Morrall, Guilford, Ind.

[73] Assignee: The Procter & Gamble Company

[ * ] Notice: This patent issued on a continued prosecution application filed under 37 CFR 1.53(d), and is subject to the twenty year patent term provisions of 35 U.S.C. 154(a)(2).

[21] Appl. No.: 589,670

[22] Filed: Jan. 22, 1996

[51] Int. Cl.[6] ..... C11D 1/72; C11D 3/30

[52] U.S. Cl. ..... 510/321; 510/281; 510/323; 510/341; 510/342; 510/350; 510/361; 510/417; 510/499

[58] Field of Search ..... 510/281, 321, 510/323, 341, 342, 350, 361, 417, 499

[56] References Cited

U.S. PATENT DOCUMENTS

| | | | |
|---|---|---|---|
| 4,045,361 | 8/1977 | Watt, Jr. et al. | 252/8.8 |
| 4,107,067 | 8/1978 | Murphy et al. | 252/135 |
| 4,149,978 | 4/1979 | Goffinet | 252/8.8 |
| 4,332,692 | 6/1982 | Payne et al. | 252/135 |
| 4,464,273 | 8/1984 | Parslow et al. | 252/8.8 |
| 4,489,455 | 12/1984 | Spendel | 8/158 |
| 4,489,574 | 12/1984 | Spendel | 68/16 |
| 4,555,019 | 11/1985 | Spendel | 206/223 |
| 4,561,991 | 12/1985 | Herbots et al. | 252/118 |
| 4,597,898 | 7/1986 | Vander Meer | 252/529 |
| 4,891,160 | 1/1990 | Vander Meer | 252/545 |
| 4,913,828 | 4/1990 | Caswell et al. | 252/88 |
| 4,973,422 | 11/1990 | Schmidt | 252/174.11 |
| 5,234,611 | 8/1993 | Trinh et al. | 252/8.8 |
| 5,470,507 | 11/1995 | Fredt et al. | 252/542 |
| 5,472,628 | 12/1995 | Panandiker et al. | 252/135 |
| 5,500,154 | 3/1996 | Bacon et al. | 252/551 |

FOREIGN PATENT DOCUMENTS

| | | | |
|---|---|---|---|
| 0 015 887 | 9/1980 | European Pat. Off. | C11D 1/66 |
| 688480 | 8/1970 | South Africa . | |
| 1 489 694 | 10/1977 | United Kingdom | C11D 1/72 |
| 2 013 259 A | 8/1979 | United Kingdom | D06L 3/02 |
| 2 257 574 | 4/1994 | United Kingdom | C11D 9/08 |

*Primary Examiner*—Margaret Einsmann
*Assistant Examiner*—Gregory R. Delcotto
*Attorney, Agent, or Firm*—Ken K. Patel; J. C. Rasser; D. Mitchell Goodrich

[57] ABSTRACT

An emulsified detergent composition is provided. The detergent composition comprises from about 0.1% to about 70%, by weight of the detergent composition, of a detersive surfactant wherein at least from about 70% to about 90%, by weight of the detersive surfactant, is a nonionic surfactant. The detergent composition also includes an electrolyte, in an amount sufficient to render the cloud point of the detergent composition to be less than about 20° C., and water. The detersive surfactant and the water are in two phases in a weight ratio of about 1:10 to about 10:1 in the detergent composition. Superior cleaning and stain removal results because the emulsified detergent composition provides separation of the water and surfactant phases in a low water wash system over a broad temperature range and allows for cleaning below the cloud point of the surfactant system.

18 Claims, No Drawings

PHASE SEPARATED DETERGENT COMPOSITION

FIELD OF THE INVENTION

The present invention relates to detergent compositions, and more particularly to emulsified detergent compositions employed in low water wash processes wherein the water and surfactant phases of the detergent composition are separated before and during use. The invention is directed to an emulsified detergent composition containing a detersive surfactant wherein from about 70% to about 90%, by weight of the detersive surfactant, is a nonionic surfactant. The composition also contains an amount of electrolyte, in water, sufficient to render the cloud point of the detergent composition to be less than about 20° C. In the detergent composition, the detersive surfactant and the water are in two phases in a weight ratio of about 1:10 to about 10:1.

BACKGROUND OF THE INVENTION

The conventional method of laundering textiles, used by United States consumers in the home, is carried out by placing from about 5 pounds to about 8 pounds of textiles into a top loading washing machine which typically uses about 45 gallons of water. Detergent is added to the machine in an amount determined by the manufacturer to provide the best cleaning results for a specified amount of textiles and volume of water. The water and detergent form what is referred to as the wash liquor. Soil is removed from the textiles and suspended in the wash liquor by mechanical agitation. At the end of the washing cycle, the wash liquor is drained from the wash basket and the textiles are rinsed with water. Additional mechanical agitation, which occurs during the rinse cycle, removes the detergent residue from the textiles. After the rinse water is drained from the wash basket, a high speed spin of the wash basket removes most of the water from the textiles.

A number of features of the conventional washing method could be improved to provide better consumer satisfaction with the process itself and the results obtained. For example, the changing of one feature, the amount of water used in the wash process, would result in a sizable cost savings to the consumer. It is well-established that the largest single factor effecting the consumer's cost per wash load is the amount of energy used to heat the water used in the washing cycle. Accordingly, it would be desirable to modify existing washing processes to consume less energy, and therefore result in a lower cost to the consumer. One such convenient way in which this can be accomplished is to reduce the amount of water consumed in the process. Appliance or washing machine manufacturers responding to this need for a washing machine have developed so-called "low water" washing machines which use about 25 gallons of water for each wash and rinse cycle or 40% less water than conventional top loading washing machines. However, for maximum cleaning benefits, the detergent used in such low water washing processes must be tailored to the machine operating conditions. Currently available detergent compositions are not optimized to deliver superior cleaning results in the newly developed low water wash systems.

During the mechanical agitation phase of a normal wash cycle, surfactants in the detergent composition can produce an excessive amount of foam, reducing the quality of the washing process. Where a reduced amount of water is used in the washing process, currently available detergent compositions almost always produce unacceptably large amounts of foam which are found aesthetically objectionable to consumers and which can reduce the level of cleaning resulting from the conventional washing process. The solution to the problem of excessive foaming lies in the use of nonionic surfactants in laundry detergent compositions since, as a group, the nonionics do not have the foaming power of anionic surfactants.

Nonionic surfactants are well suited to formulation in laundry detergents since their hydrophilic group is chemically inert and they can be made compatible with many different types of builders. Detergent compositions which include nonionic surfactant generally require high concentrations in the wash for a significant benefit, as opposed to compositions comprising mainly anionics which are usable at lower concentrations. The high concentrations of nonionic surfactant necessary for the production of significant benefits are attainable in the low water wash systems described herein.

The laundry detergent compositions described herein and composed of high amounts of nonionic surfactants exhibit superior cleaning performance, over conventional detergents used in low water wash systems, because the detersive surfactant is partially colloidal and present as micelles. In conventional liquid detergents, which contain a high concentration of anionic surfactants, the detersive surfactant species exist mainly as monomers. Conventional detergent solutions containing a large proportion of monomeric surfactant species have long been selected by workers in the art for use in washing because they act much faster, under prior art conditions, than highly micellized solutions. However, these monomeric solutions are not satisfactory in a low water wash system where the most effective cleaning can only result if the water and surfactant phases separate. In conventional washing processes, separation of the water and surfactant phases is prevented by the presence of fatty acids from soiled fabrics in the wash liquor. Furthermore, current detergent formulations do not adequately separate during low water wash processes so as to provide effective cleaning and prevent redeposition. This problem is exacerbated further when the low water wash process is operated at relative low temperatures (i.e., less than about 25° C.) as is typical in many countries such as the United States of America and Japan.

The emulsified laundry detergent compositions described herein solve the problem of ineffective cleaning which results from the use of monomeric surfactant species in a low water wash system by providing for separation of the surfactant and water phases before and during cleaning. As a result of the separation, the resulting surfactant-rich phase, which consists of elongated rod-like micelles, directly interacts with the surface of the clothes and modifies the soil to produce superior cleaning. The subsequent rinse removes the soil from the substrate and the soil is solubilized in an emulsion, thus preventing redeposition.

The emulsified laundry detergent compositions described herein solve the problem of excessive amounts of suds formed during the washing process. In the past, detergent compositions used in machines employing low water wash processes included higher levels of relatively expensive suds suppressors which obviously increased the cost of the detergent product. Thus, it would be desirable to have a detergent composition specifically tailored for low water wash machines which provides superior cleaning at low washing temperatures without the need for high levels of expensive suds suppressors.

Accordingly, despite the aforementioned disclosures in the art, the need exists for a commercially available detergent composition which exhibits superior cleaning in laundry machines employing low water wash processes, especially at low wash water temperatures. There is also a need for a detergent composition which provides such superior cleaning without the need for high levels of suds suppressors. Furthermore, despite disclosures in the detergency art of detergent compositions comprising a nonionic surfactant, strong electrolyte and builder, used in a washing liquor where the surfactant coexists in a single phase with water, the need exists for an emulsified detergent composition which provides for a phase separation mechanism of soil removal over a broad washing temperature range.

BACKGROUND ART

The following patents disclose detergent compositions containing nonionic surfactants: Payne et al, U.S. Pat. No. 4,332,692 (The Procter & Gamble Company); Vander Meer, U.S. Pat. No. 4,597,898 (The Procter & Gamble Company); Vander Meer, U.S. Pat. No. 4,891,160 (The Procter & Gamble Co.); Payne et al, EP 0015887 (The Procter & Gamble Company); Lagasse et al, UK 1489694 (The Procter & Gamble Company); Hawkins, GB 2271574 (Albright & Wilson Limited).

SUMMARY OF THE INVENTION

The aforementioned needs in the art are met by the present invention which provides an emulsified detergent composition which provides separation of the water and surfactant phases in a low water wash system resulting in superior cleaning and stain removal. The detergent composition comprises high levels of a nonionic surfactant and an electrolyte in water, in an amount sufficient to render the cloud point of the detergent composition to be less than about 20° C.

As used herein, "low water wash process", refers to a washing process where the total amount of wash and rinse water employed in all cycles of a commercially available washing machine is no more than 45 gallons, preferably less than 25 gallons or the concentration of the detergent is from about 2,000 parts per million (ppm) to about 10,000 ppm.

As used herein, "hydrophilic/lipophilic balance index" or "HLB" means a numerical index for a given surfactant structure, indicating its balance of hydrophilic and lipophilic properties. A surfactant with a high HLB is more hydrophilic and less lipophilic in character than a surfactant with a low HLB.

As used herein, "cloud point" or "cloud point temperature" means the minimum temperature at which a sharp increase in light scatter is detected on a photo gonio diffusometer due to the formation of muclei of sufficient size to scatter light, i.e., the minimum temperature at which a sharp increase in cloudiness is observed in an aqueous surfactant solution as it is heated. Essentially, the cloud point is the temperature at which an aqueous solution of nonionics will precipitate. The existence of a cloud point is one of the indicia of nonionic surfactants which are useful to practice the present invention.

As used herein, "phase coalescence temperature" means the minimum temperature at which a solution comprising a nonionic surfactant and water separates into two bulk phases, as distinguished from the cloud point temperature at which a single, colloidal bulk phase is observed. (The two bulk phases above the phase coalescence temperature are a largely dehydrated surfactant phase and a phase which is largely water).

As used herein, "an electrolyte in an amount sufficient to render the cloud point of the detergent composition to be less than about 20° C." refers to any appropriate bonded substance for inclusion in an emulsified detergent composition which completely ionizes in aqueous solution at concentrations of from about 50 ppm to about 10,000 ppm.

As used herein, "broad temperature range" means washing temperatures of from about 20° C. to about 75° C.

In accordance with one aspect of the invention, an emulsified detergent composition is provided herein. The detergent composition comprises from about 0.1% to about 70%, by weight of the detergent composition, of a detersive surfactant wherein at least about 70% to about 90%, by weight of the detersive surfactant, is a nonionic surfactant. In addition, the detergent composition includes an electrolyte in an amount sufficient to render the cloud point of the detergent composition to be less than about 20° C. The balance of the emulsified detergent composition is water. The detersive surfactant and the water are in two phases in a weight ratio of about 1:10 to about 10:1 in the detergent composition. The emulsified detergent composition produces the separation of the water and surfactant phases necessary for optimal cleaning and stain removal in washing machines employing a low water wash process.

In another embodiment of the invention, an emulsified detergent composition which comprises from about 0.1% to about 70% by weight of a detersive surfactant selected from the group consisting of polyhydroxy fatty acid amides, alcohol ethoxylates, alkyl phenol ethoxylates and mixtures thereof is provided. Additionally, the emulsified detergent composition comprises from about 1% to about 5% by weight of a water-soluble ethoxylated amine selected from the group consisting of ethoxylated monoamines, ethoxylated diamines, ethoxylated polyamines and mixtures thereof. The emulsified detergent composition also contains from about 0.01% to about 5% of polyethylene glycol, from about 0.05% to about 10% of an electrolyte and water. The cloud point of the detergent composition is preferably less than about 20° C. The detersive surfactant and the water are in two phases in a weight ratio of from about 1:10 to about 10:1 in the detergent composition.

In a preferred embodiment, the emulsified detergent composition comprises from about 25% to about 35% by weight of a $C_{10-12}$ ethoxylated fatty alcohol having at least about 4 ethylene oxide units per mole. In addition to water, the composition also comprises from about 1% to about 3% by weight of citric acid, from about 0.005% to about 4% by weight of an ethoxylated tetraethylenepentamine, from about 0.01% to about 2% by weight of polyethylene glycol, from about 0.1% to about 0.5% by weight of protease enzyme and from about 5% to about 25% of a hydrocarbon. From about 0.1% to about 5%, by weight, of an electrolyte is present in the composition. The cloud point of the detergent composition is from about −10° C. to about 25° C. and the detersive surfactant and the water are in two separate phases in a weight ratio of about 1:7 to about 2:1 in the detergent composition.

In accordance with other aspects of the invention, methods of laundering and pretreating soiled fabrics are also provided. The method of laundering soiled fabrics comprises the step of contacting soiled fabrics with an effective amount of detergent composition as described herein in an aqueous laundering solution. The method of pretreating soiled fabrics comprises the step of contacting said fabrics with an effective amount of a detergent composition prior to the laundering of the soiled fabrics.

Accordingly, it is an object of the present invention to provide an emulsified detergent composition which is capable of producing superior cleaning and stain removal over currently available commercial formulations when used in a low water wash process, by producing separation of the water and surfactant phases in the wash process over a broad temperature range. It is also an object of the present invention to provide a detergent composition, which when used at high levels as in a low water wash system, would provide separation of water and surfactant phases at temperatures above the cloud point. These and other objects, features and attendant advantages of the present invention will become apparent to those skilled in the art from reading of the following detailed description of the preferred embodiment and the appended claims.

All documents, including patents and publications cited herein, are incorporated by reference. As used herein, all percentages, proportions, and ratios are by weight unless otherwise specified.

DETAILED DESCRIPTION OF THE PREFERRED EMBODIMENT

The aforementioned needs in the art are met by the present invention which provides an emulsified detergent composition which exhibits superior cleaning in laundry machines employing low water wash processes, especially at low wash water temperatures. Additionally, the emulsified detergent composition provides such superior cleaning without the high levels of suds suppressors generally found in conventional commercially available detergent compositions. Furthermore, the present inventions provides an emulsified detergent composition wherein separation of the water and surfactant phases is achieved in a low water wash system. The detergent composition provided herein comprises high levels of a nonionic surfactant, an electrolyte in an amount sufficient to render the cloud point of the detergent composition to be less than about 20° C., and water.

Commercially available known laundry detergent formulations usually contain agents to suppress the formation of excessive foam which results from mechanical agitation during the wash process. In addition, known laundry formulations generally contain a large proportion of monomeric surfactant species. In low water washing systems maximum cleaning is obtained when the amount of suds produced by mechanical agitation is low and when the water and surfactant species exist in two separate phases. It has been found that an emulsified detergent composition which comprises a detersive surfactant, electrolyte and water produces reduced amounts of foam in a low water wash process, separation of the water and surfactant phases before and during washing, and unexpectedly superior cleaning and stain removal.

Preferably such an emulsified detergent composition comprises from about 0.1% to about 70%, by weight of a detersive surfactant wherein at least about 70% to about 90% by weight of the detersive surfactant is a nonionic surfactant. More preferably, the nonionic surfactant is selected from the group consisting of polyhydroxy fatty acid amides, alcohol ethoxylates, alkyl phenol ethoxylates and mixtures thereof. Most preferably the emulsified detergent composition comprises from about 25% to about 35% by weight of a $C_{10-12}$ ethoxylated fatty alcohol having at least about 4 ethylene oxide units per mole. The emulsified detergent composition also comprises an electrolyte in an amount sufficient to render the cloud point of the detergent composition to be less than about 20° C. More preferably, the emulsified detergent composition comprises from about 0.05% to about 10%, and most preferably from about 0.1% to 5% of an electrolyte.

Detergent compositions containing nonionic surfactants are known to be especially good at removing grease and oil stains. Additionally, it is well known to those skilled in the art that ethoxylated tetraethylenepentamine is an efficient clay soil removal agent and an agent that prevents redeposition of soil. Soil redeposition refers to the process whereby soil, already removed from the textiles in the wash cycle, is onto the textile in either the wash cycle or in the rinse cycle. Redeposition reduces the overall amount of soil removed and make the clothes look dingy. The phenomenon of soil redeposition contributes the consumer dissatisfaction with the wash process.

The present invention produces the unexpected result that the addition of 400 or more parts per million of polyethylene glycol in combination with greater than 500 or more parts per million of ethoxylated tetraethylenepentamine results in a concomitant increase in the removal of both surfactant sensitive stains (such as grease and oil) and dispersant sensitive stains (such as clay). The effect exhibited by the combination of polyethylene glycol and ethoxylated tetraethylenepentamine is greater than the stain removal ability of either dispersant alone. The emulsified detergent composition may also include one or more of adjunct detergent ingredients. Nonlimiting examples of the detergency surfactant, electrolyte, clay soil removal/anti-redeposition agents, detergency builders, enzymes, enzyme stabilizers, suds suppressors and adjunct ingredients are described in detail hereinafter.

Surfactant

The composition of the invention includes a surfactant preferably from the group consisting of nonionic, anionic, cationic, zwitterionic and amphoteric surfactants and mixtures thereof. Nonlimiting examples of surfactants useful herein typically at levels from about 0.1% to about 70%, by weight of the detergent composition, include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)$ $CH_3$ and $CH_3(CH_2)_y(CHOSO_3^-M^+)$ $CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters.

In a preferred embodiment of the instant invention, the emulsified detergent composition comprises from about 0.1% to about 70% by weight of a detersive surfactant selected from the group consisting of polyhydroxy fatty acid amides, alcohol ethoxylates, alkyl phenol ethoxylates and mixtures thereof. The polyhydroxy fatty acid amide nonionic surfactants are those which conform to the formula:

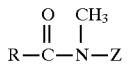

wherein R is a $C_{9-17}$ alkyl or alkenyl and Z is glycityl derived from a reduced sugar or alkoxylated derivative thereof. Such materials include the $C_{12}$–$C_{18}$ N-methyl glucamides. See WO 9,206,154. Examples are N-methyl N-1-deoxyglucityl cocoamide and N-methyl N-1-deoxyglucityl oleamide. Processes for making polyhydroxy fatty acid amides are known and can be found, for example, in Wilson, U.S. Pat. No. 2,965,576 and Schwartz, U.S. Pat. No. 2,703,798, the disclosures of which are incorporated herein by reference. The materials themselves and their preparation are also described in greater detail in Honsa, U.S. Pat. No. 5,174,937, Issued Dec. 26, 1992, which patent is also incorporated herein by reference. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing.

Another suitable component of the nonionic surfactant used in the compositions herein comprises an ethoxylated fatty alcohol nonionic surfactant. Such materials are those which correspond to the general formula:

$$R^1(C_2H_4O)_nOH$$

wherein $R^1$ is a $C_8$ –$C_{16}$ alkyl group or a $C_6$ –$C_{12}$ alkylphenol group and n ranges from about 1 to 80. Preferably $R^1$ is an alkyl group, which may be primary or secondary, that contains from about 9 to 15 carbon atoms, more preferably from about 10 to 14 carbon atoms. In a most preferred embodiment of the instant invention, the emulsified detergent composition comprises from about 25% to about 35% by weight of a $C_{10-12}$ alkyl ethoxylated fatty alcohol having at least about 4 ethylene oxide units per mole.

The weight ratio of the surfactant to water is preferably from about 1:10 to about 10:1, more preferably from about 1:7 to about 5:1, and most preferably, 1:7 to 2:1, in the emulsified detergent composition. The ethoxylated fatty alcohol nonionic surfactant will frequently have a hydrophilic-lipophilic balance (HLB) which ranges from about 3 to 17. More preferably, the emulsified detergent composition of the instant invention comprises an ethoxylated fatty alcohol wherein the hydrophilic-lipophilic balance ranges from about 8.7 to about 12.3. Fatty alcohol ethoxylates have been commercially marketed under the trade names NEODOL® 25-7 and NEODOL 23-6.5 by Shell Chemical Company. Other useful NEODOLs include NEODOL 1-5, an ethoxylated fatty alcohol averaging 11 carbon atoms in its alkyl chain with about 5 moles of ethylene oxide; NEODOL 23-9, an ethoxylated primary $C_{12}$ –$C_{13}$ alcohol having about 9 moles of ethylene oxide and NEODOL 91-10, an ethoxylated $C_9$–$C_{11}$ primary alcohol having about 10 moles of ethylene oxide. Alcohol ethoxylates of this type have also been marketed by Shell Chemical Company under the DOBANOL® tradename. DOBANOL 91-5 is an ethoxylated $C_9$–$C_{11}$ fatty alcohol with an average of 5 moles ethylene oxide and DOBANOL® 25-7 is an ethoxylated $C_{12}$–$C_{15}$ fatty alcohol with an average of 7 moles of ethylene oxide per mole of fatty alcohol.

Other examples of suitable ethoxylated alcohol nonionic surfactants include TERGITOL® 15-S-7 and TERGITOL 15-S-9 both of which are linear secondary alcohol ethoxylates that have been commercially marketed by Union Carbide Corporation. The former is a mixed ethoxylation product of $C_{11}$ to $C_{15}$ linear secondary alkanol with 7 moles of ethylene oxide and the latter is a similar product but with 9 moles of ethylene oxide being reacted.

Other types of alcohol ethoxylate nonionics useful in the present compositions are higher molecular weight nonionics, such as NEODOL® 45-11, which are similar ethylene oxide condensation products of higher fatty alcohols, with the higher fatty alcohol being of 14–15 carbon atoms and the number of ethylene oxide groups per mole being about 11. Such products have also been commercially marketed by Shell Chemical Company.

The conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. Other conventional useful surfactants are listed in standard texts.

Electrolyte

It will be appreciated by those skilled in the art of formulating nononic surfactant compositions that the addition of nearly any strong electrolyte to a system containing a nonionic surfactant will lower the cloud point of the surfactant system, as well as the phase coalescence temperature. Just a very few examples of appropriate electrolytes are the water-soluble chemical compounds of an anion selected from chloride, bromide, silicate, orthosilicate, metasilicate, orthophosphate, sulfate, carbonate, nitrate, fluoride, acetate, hydroxide, citrate, and others, and a cation selected from sodium potassium, lithium, calcium, magnesium and hydrogen. This list is by no means exhaustive, and those skilled in the art will easily select any of a wide variety of strong electrolytes, depending on the availability of particular salts and other factors.

The emulsified detergent composition of the instant invention preferably contains an electrolyte in an amount sufficient to render the cloud point of the detergent composition to be less than about 20° C. More preferably the emulsified detergent composition contains from about 0.05% to about 10% of an electrolyte and most preferably from about 0.1% to about 5%.

Preferred electrolytes are those which supply alkalinity to the washing medium, although a high degree of alkalinity is not necessary to practice the present invention. Of electrolytes noted above, the sodium salts are highly preferred as strong electrolytes because they are highly soluble and inexpensive, and of those sodium salts, sodium carbonate is the most preferred strong electrolyte in the practice of the present invention. Typically the amount of a strong electrolyte which must be added to the washing liquor to optimize the cloud point and micelle inversion temperatures will lie between about 50 ppm and 10,000 ppm.

Clay Soil Removal/Anti-redeposition Agents

The compositions of the present invention can also optionally contain water-soluble ethoxylated amines having clay soil removal and antiredeposition properties. The emulsified detergent composition disclosed herein may contain from about 1% to about 5%, by weight, of a water-soluble ethoxylated amine selected from the group consisting of ethoxylated monoamines, ethoxylated diamines, ethoxylated polyamines, and mixtures thereof. The most preferred soil release and antiredeposition agent is ethoxylated tetraethylenepentamine. A highly preferred emulsified detergent composition embodiment of the instant invention would contain from about 0.005% to about 4% by weight of an ethoxylated tetraethylenepentamine.

Exemplary ethoxylated amines are further described in U.S. Pat. No. 4,597,898, Vander Meer, issued Jul. 1, 1986. Another group of preferred clay soil removal-antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or antiredeposition agents known in the art can also be utilized in the compositions herein. Another type of preferred antiredeposition agent includes the carboxymethyl cellulose materials. These materials are well known in the art.

Builders

Detergent builders can optionally be included in the compositions herein to assist in controlling mineral hardness. Inorganic as well as organic builders can be used. Builders are typically used in fabric laundering compositions to assist in the removal of particulate soils.

The level of builder optionally included in the emulsified detergent composition can be about 0.2% to about 10% by weight. Lower or higher levels of builder, however, are not meant to be excluded. The builder is preferably selected from the group consisting of citric acid, aluminosilicates, carbonates, phosphates and mixtures thereof.

Citrate builders, e.g., citric acid and soluble salts thereof (particularly sodium salt), are polycarboxylate builders of particular importance for heavy duty liquid detergent formulations due to their availability from renewable resources and their biodegradability. The emulsified detergent composition preferably contains from about 1% to about 3% by weight of citric acid.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Since aluminosilicate builders can be a significant builder in liquid detergent formulations, aluminosilicate builders are useful in the present invention. Aluminosilicate builders include those having the empirical formula:

$$M_z[(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the NaSKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Examples of carbonate builder usefuil in the present invention are the alkaline earth and alkali metal carbonates as disclosed in German Patent Application No. 2,321,001 published on Nov. 15, 1973.

Inorganic or phosphate-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1, 3, 5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322. Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which is desirable in the instant invention.

Enzymes

Enzymes can be optionally included in the formulations herein for a wide variety of fabric laundering purposes, including removal of protein-based, carbohydrate-based, or triglyceride-based stains, for example, and for the prevention of refugee dye transfer, and for fabric restoration. Enzymes in the instant emulsified detergent composition comprise preferably from about 0.01% to about 2%, by weight, and more preferably from about 0.1% to about 0.5%, by weight. The enzymes to be incorporated include proteases, amylases, cellulases, lipases and mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on.

Bacterial or fungal enzymes are preferred, such as bacterial amylases and proteases, and fungal cellulases. A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for liquid detergent formulations, and their incorporation into such liquid or emulsified formulations, are disclosed in U.S. Pat. No. 4,261,868, Hora et al, issued Apr. 14, 1981.

Suitable examples of proteases are the subtilisins which are obtained from particular strains of *Bacillus subtilis* and *Bacillus licheniforms*. Another suitable protease is obtained from a strain of Bacillus, having maximum activity throughout the pH range of 8–12, developed and sold by Novo Industries A/S under the registered trade name ESPERASE®. The preparation of this enzyme and analogous enzymes is described in British Patent Specification No. 1,243,784 of Novo. Proteolytic enzymes suitable for removing protein-based stains that are commercially available include those sold under the tradenames ALCALASE® and SAVINASE® by Novo Industries A/S (Denmark) and MAXATASE® by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

Amylases include, for example, α-amylases described in British Patent Specification No. 1,296,839 (Novo), RAPIDASE®, International Bio-Synthetics, Inc. and TERMAMYL®, Novo Industries.

The cellulase enzymes used in the instant emulsified detergent composition are preferably incorporated at levels sufficient to provide up to about 5 mg by weight, more preferably about 0.01 mg to about 3 mg, of active enzyme per gram of the composition. The cellulase suitable for the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from *Humicola insolens* and *Humicola strain* DSM1800 or a cellulase 212-producing fungus belonging to the genus Aeromonas, and cellulase extracted from the hepatopancreas of a marine mollusk (Dolabella Auricula Solander), suitable cellulases are also disclosed in GB-A-2.075.028; GB-A-2.095.275 and DE-OS-2.247.832. In addition, cellulase especially suitable for use herein are disclosed in WO 92-13057 (The Procter & Gamble Company). Most preferably, the cellulases used in the instant detergent compositions are purchased commercially from NOVO Industries A/S under the product names CAREZYME® and CELLUZYME®.

Suitable lipase enzymes for detergent usage include those produced by microorganisms of the Pseudomonas group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases from *Chromobacter viscosum*, e.g. Chromobacter viscosum var. lipolyticum NRRLB 3673, commercially available from Toyo Jozo Co., Tagata, Japan; and further *Chromobacter viscosum* lipases from U.S. Biochemical Corp., U.S.A. and Disoynth Co., The Netherlands, and lipases from *Pseudomonas gladioli*. The LIPOLASE® enzyme derived from *Humicola lanuginosa* and commercially available from Novo (see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

Enzyme Stabilizers

Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570. Enzyme stabilizers can optionally be incorporated into the emulsified detergent compositions disclosed herein.

The enzymes optionally employed herein can be stabilized by the presence of water-soluble sources of calcium and/or magnesium ions in the finished compositions which provide such ions to the enzymes. (Calcium ions are generally somewhat more effective than magnesium ions and are preferred herein if only one type of cation is being used.) Additional stability can be provided by the presence of various other art-disclosed stabilizers, especially borate species: see Severson, U.S. Pat. No. 4,537,706. Typical detergents, especially liquids, will comprise from about 1 to about 30, preferably from about 2 to about 20, more preferably from about 5 to about 15, and most preferably from about 8 to about 12, millimoles of calcium ion per liter of finished composition. This can vary somewhat, depending on the amount of enzyme present and its response to the calcium or magnesium ions. The level of calcium or magnesium ions should be selected so that there is always some minimum level available for the enzyme, after allowing for complexation with builders, fatty acids, etc., in the composition. Any water-soluble calcium or magnesium salt can be used as the source of calcium or magnesium ions, including, but not limited to, calcium chloride, calcium sulfate, calcium malate, calcium maleate, calcium hydroxide, calcium formate, and calcium acetate, and the corresponding magnesium salts. A small amount of calcium ion, generally from about 0.05 to about 0.4 millimoles per liter, is often also present in the composition due to calcium in the enzyme slurry and formula water.

It is to be understood that the foregoing levels of calcium and/or magnesium ions are sufficient to provide enzyme stability. More calcium and/or magnesium ions can be added to the compositions to provide an additional measure of grease removal performance. Accordingly, as a general proposition the compositions herein will typically comprise from about 0.05% to about 2% by weight of a water-soluble source of calcium or magnesium ions, or both. The amount can vary, of course, with the amount and type of enzyme employed in the composition.

The compositions herein may also optionally, but preferably, contain various additional stabilizers, especially borate-type stabilizers. Typically, such stabilizers will be used at levels in the compositions from about 0.25% to about 10%, preferably from about 0.5% to about 5%, more preferably from about 0.75% to about 3%, by weight of boric acid or other borate compound capable of forming boric acid in the composition (calculated on the basis of boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

Suds Suppressors

Compounds for reducing or suppressing the formation of suds can be incorporated optionally into the compositions of the present invention but are not required. Suds suppression can be of particular importance in the so-called "high concentration cleaning process" as described in U.S. Pat. Nos. 4,489,455 and 4,489,574, in the "low water wash process" as it is described in this invention, and in front-loading European-style washing machines. However, the formulations of the emulsified detergent compositions presented herein produce a low amount of suds without the addition of extrinsic suds suppressors.

For any detergent compositions to be used in automatic laundry washing machines, suds should not form to the extent that they overflow the washing machine. Suds suppressors, when utilized, are preferably present in a "suds suppressing amount". By "suds suppressing amount" is meant that the formulator of the composition can select an amount of this suds controlling agent that will sufficiently control the suds to result in a low-sudsing laundry detergent for use in automatic laundry washing machines.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein may also contain nonsurfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. The invention disclosed herein can comprise from about 1% to about 25% and preferably from about 5% to about 25%, by weight, of a hydrocarbon and preferably the hydrocarbon can be a terpene. The hydrocarbons such as paraffin and haloparaffin can be utilized in liquid form. The liquid hydrocarbons will be liquid at room temperature and atmospheric pressure, and will have a pour point in the range of about −40° C. and about 50° C., and a minimum boiling point not less than about 110° C. (atmospheric pressure). It is also known to utilize waxy hydrocarbons, preferably having a melting point below about 100° C. The hydrocarbons constitute a preferred category of suds suppressor for detergent compositions. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin," as used in this suds suppressor discussion, is intended to include mixtures of true paraffins and cyclic hydrocarbons. Preferably, the hydrocarbon is selected from the group consisting of terpenes and perfilmes.

Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g., K, Na, and Li) phosphates and phosphate esters. Another preferred category of nonsurfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779, issued May 5, 1981 to Gandolfo et al and European Patent Application No. 89307851.9, published Feb. 7, 1990, by Starch, M. S. Other silicone suds suppressors are disclosed in U.S. Pat. No. 3,455,839 which relates to compositions and processes for defoaming aqueous solutions by incorporating therein small amounts of polydimethylsiloxane fluids.

An exemplary silicone based suds suppressor for use herein is a suds suppressing amount of a suds controlling agent consisting essentially of:

(1) polydimethylsiloxane fluid having a viscosity of from about 20 centistokes (cs) to about 1,500 cs at 25° C.;

(2) from about 5 to about 50 parts per 100 parts by weight of siloxane resin composed of $(CH_3)_3SiO_{1/2}$ units of $SiO_2$ units in a ratio of from $(CH_3)_3$ $SiO_{1/2}$ units and to $SiO_2$ units of from about 0.6:1 to about 1.2:1; and (3) from about 1 to about 20 parts per 100 parts by weight of a solid silica gel.

In the preferred silicone suds suppressor used herein, the solvent for a continuous phase is made up of certain polyethylene glycols or polyethylene-polypropylene glycol copolymers or mixtures thereof, or polypropylene glycol. The primary silicone suds suppressor is branched/crosslinked and preferably not linear.

To illustrate this point further, typical liquid laundry detergent compositions with controlled suds will optionally comprise from about 0.001 to about 1, preferably from about 0.01 to about 0.7, most preferably from about 0.05 to about 0.5, weight % of said silicone suds suppressor, which comprises:

(1) a nonaqueous emulsion of a primary antifoam agent which is a mixture of: (a) a polyorganosiloxane, (b) a resinous siloxane or a silicone resin-producing silicone compound, (c) a finely divided filler material, and (d) a catalyst to promote the reaction of mixture components (a), (b) and (c), to form silanolates;

(2) at least one nonionic silicone surfactant; and (3) polyethylene glycol or a copolymer of polyethylene-polypropylene glycol having a solubility in water at room temperature of more than about 2 weight percent; and without polypropylene glycol.

See also U.S. Pat. Nos. 4,978,471, Starch, issued Dec. 18, 1990, and 4,983,316, Starch, issued Jan. 8, 1991, 5,288,431, Huber et al., issued Feb. 22, 1994, and U.S. Pat. Nos. 4,639,489 and 4,749,740, Aizawa et al at column 1, line 46 through column 4, line 35.

The silicone suds suppressor herein preferably comprises polyethylene glycol and a copolymer of polyethylene glycol/polypropylene glycol, all having an average molecular weight of less than about 1,000, preferably between about 100 and 800. The polyethylene glycol and polyethylene/polypropylene copolymers herein have a solubility in water at room temperature of more than about 2 weight percent, preferably more than about 5 weight percent.

The preferred solvent herein is polyethylene glycol having an average molecular weight of about 4,000. The emulsified detergent composition preferably comprises from about 0.01% to about 5%, by weight, of polyethylene glycol. More preferably, the emulsified detergent composition comprises from about 0.01% to about 2%, by weight, polyethylene glycol.

The preferred silicone suds suppressors used herein do not contain polypropylene glycol, particularly of 4,000 molecular weight. They also preferably do not contain block copolymers of ethylene oxide and propylene oxide, like PLURONIC L101.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL® 12. Mixtures of secondary alcohols are available under the trademark ISALCHEM® 123 from Enichem. Mixed suds suppressors typically comprise mixtures of alcohol and silicone at a weight ratio of 1:5 to 5:1.

The compositions herein will generally comprise from 0% to about 5% of suds suppressor. When utilized as suds suppressors, monocarboxylic fatty acids, and salts therein, will be present typically in amounts up to about 5%, by weight, of the detergent composition. Preferably, from about 0.5% to about 3% of fatty monocarboxylate suds suppressor is utilized. Silicone suds suppressors are typically utilized in amounts up to about 2%, by weight, of the detergent composition, although higher amounts may be used. This upper limit is practical in nature, due primarily to concern with keeping costs minimized and effectiveness of lower amounts for effectively controlling sudsing. Preferably from about 0.01% to about 1% of silicone suds suppressor is used, more preferably from about 0.25% to about 0.5%. As used herein, these weight percentage values include any silica that may be utilized in combination with polyorganosiloxane, as well as any adjunct materials that may be utilized. Monostearyl phosphate suds suppressors are generally utilized in amounts ranging from about 0.1% to about 2%, by weight, of the composition. The alcohol suds suppressors are typically used in amounts ranging from about 0.2% to about 3%, by weight, of the finished compositions.

Adjunct Ingredients

A wide variety of other ingredients usefuil in detergent compositions can be included in the compositions herein, including other active ingredients, carriers, hydrotropes, processing aids, dyes or pigments and solvents for liquid formulations. Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., 1,3-propanediol, ethylene glycol, glycerine, and 1,2-propanediol) can also be used. The compositions may contain from 5% to 90%, typically 10% to 50% of such carriers.

The detergent compositions herein will preferably be formulated such that, during use in aqueous cleaning operations, the wash water will have a pH of between about 6.5 and about 11, preferably between about 7.5 and 10.5. Laundry products are typically at pH 9 to 11 and the emulsified detergent composition in the instant invention will preferably have a pH of from about 7 to about 10, and more preferably have a pH of from about 7.5 to 8.5. Techniques for controlling pH at recommended usage levels include the use of buffers, alkalis, acids, etc., and are well known to those skilled in the art.

Detergent Composition Formulation

The detergent compositions according to the present invention can be in the form of an emulsion or a liquid. Such compositions can be prepared by combining the essential and optional components in the requisite concentrations in any suitable order and by an conventional means.

Liquid detergent compositions can be prepared by admixing the essential and optional ingredients thereof in any desired order to provide compositions containing components in the requisite concentrations. Liquid compositions according to the present invention can also be in "compact form", useful for pretreating soiled fabrics prior to washing. In such case, the liquid detergent compositions according to the present invention will contain a lower amount of water, compared to conventional liquid detergents.

In order to make the present invention more readily understood, reference is made to the following examples, which are intended to be illustrative only and not intended to be limiting in scope.

EXAMPLES I–IV

Several emulsified detergent compositions, specifically suitable for low water wash processes, are prepared as follows:

| | Examples (% Weight) | | | |
|---|---|---|---|---|
| Component | I | II | III | IV |
| $C_{12-13}$ linear alkyl benzene sulfonate | 0.0 | 0.0 | 0.0 | 0.5 |
| $C_{14-15}$ alkyl sulfate | 0.0 | 0.0 | 0.0 | 0.0 |
| $C_{14-15}$ alkyl ethoxylate sulfate | 0.0 | 0.0 | 0.0 | 0.0 |
| $C_{12-13}$ polyethoxylate (4–5) | 25.0 | 31.0 | 31.2 | 30.7 |
| Polyethylene glycol (MW = 4000) | 0.1 | 0.1 | 0.9 | 0.9 |
| Citric acid | 1.5 | 2.9 | 2.9 | 2.9 |
| Ethoxylated tetraethylenepentamine | 0.1 | 0.1 | 2.0 | 2.0 |
| Hydrocarbon(i.e., terpenes) | 10.0 | 6.4 | 6.2 | 6.2 |
| Protease | 0.2 | 0.2 | 0.2 | 0.2 |
| Water | 63.1 | 59.3 | 56.6 | 56.6 |
| | 100.0 | 100.0 | 100.0 | 100.0 |

EXAMPLES V–VIII

Several emulsified detergent compositions, specifically suitable for use in pretreating soiled fabrics before washing, are prepared as follows:

| | Examples (% Weight) | | | |
|---|---|---|---|---|
| Component | V | VI | VII | VIII |
| $C_{12-13}$ linear alkyl benzene sulfonate | 0.0 | 0.0 | 0.0 | 1.0 |
| $C_{14-16}$ alkyl sulfate | 0.0 | 0.0 | 0.0 | 0.0 |
| $C_{14-15}$ alkyl ethoxylate sulfate | 0.0 | 0.0 | 0.0 | 0.0 |
| $C_{12-13}$ polyethoxylate (4–5) | 61.2 | 68.8 | 64.7 | 63.7 |
| Polyethylene glycol (MW = 4000) | 0.1 | 0.1 | 1.9 | 1.9 |
| Citric acid | 3.7 | 6.4 | 6.0 | 6.0 |
| Ethoxylated tetraethylenepentamine | 0.1 | 0.1 | 4.2 | 4.2 |
| Hydrocarbon (i.e., terpenes) | 24.5 | 14.2 | 12.9 | 12.9 |
| Protease | 0.5 | 0.4 | 0.4 | 0.4 |
| Water | 9.9 | 10.0 | 9.9 | 9.9 |
| | 100.0 | 100.0 | 100.0 | 100.0 |

Having thus described the invention in detail, it will be clear to those skilled in the art that various changes may be made without departing from the scope of the invention and the invention is not to be considered limited to what is described in the specification. The present invention meets the aforementioned needs in the art by providing an emulsified detergent composition which produces separation of the water and surfactant phases during the wash process and provides superior cleaning.

What is claimed is:

1. An emulsified detergent composition, comprising:

(a) from about 0.1% to about 70%, by weight of the detergent composition, of a detersive surfactant wherein at least about 70% to about 90%, by weight of the detersive surfactant, is a nonionic surfactant;

(b) an electrolyte in an amount sufficient to render the cloud point of the detergent composition is from about −10° C. to about 20° C.; and (c) the balance water;

whereby the detersive surfactant and the water are in two phases in a weight ratio of about 1:10 to about 10:1 in the detergent composition.

2. An emulsified detergent composition according to claim 1 further comprising from about 1% to about 5%, by weight of said composition, of a water-soluble ethoxylated amine selected from the group consisting of ethoxylated monoamines, ethoxylated diamines, ethoxylated polyamines and mixtures thereof.

3. An emulsified detergent composition according to claim 1 further comprising from about 0.01% to about 5% of polyethylene glycol.

4. An emulsified detergent composition according to claim 1 further comprising from about 0.01% to about 2% of an enzyme.

5. A composition according to claim 4 wherein said enzyme is selected from the group consisting of proteases, amylases, cellulases, lipases and mixtures thereof.

6. An emulsified detergent composition according to claim 1 further comprising from about 0.2% to about 10% of a builder, wherein said builder is selected from the group consisting of aluminosilicates, phosphates, and mixtures thereof, and said electrolyte is a water-soluble chemical compound of an anion selected from the group consisting of chloride, bromide, sulfate, carbonate, nitrate, fluoride, acetate, hydroxide, and citrate, and a cation selected from the group consisting of sodium, potassium, lithium, calcium, magnesium, and hydrogen.

7. An emulsified detergent composition according to claim 1 further comprising from about 1% to about 25% of a hydrocarbon.

8. An emulsified detergent composition according to claim 7 wherein said hydrocarbon is a terpene.

9. An emulsified detergent composition according to claim 1 having a pH of from about 7 to about 10.

10. An emulsified detergent composition, comprising:

(a) from about 0.1% to about 70% by weight of a detersive surfactant selected from the group consisting of polyhydroxy fatty acid amides, alcohol ethoxylates, alkyl phenol ethoxylates and mixtures thereof;

(b) from about 1% to about 5% by weight of a water-soluble ethoxylated amine selected from the group consisting of ethoxylated monoamines, ethoxylated diamines, ethoxylated polyamines and mixtures thereof;

(c) from about 0.01% to about 5% of polyethylene glycol;

(d) from about 0.05% to about 10% of an electrolyte; and (e) the balance water;

whereby the cloud point of the detergent composition is from about −10° C. to about 20° C., and the detersive surfactant and the water are in two phases in a weight ratio of about 1:10 to about 10:1 in the detergent composition.

11. An emulsified detergent composition according to claim 10 further comprising from about 0.01% to about 2% of an enzyme.

12. An emulsified detergent composition according to claim 10 wherein the weight ratio of the surfactant to water is from about 1:7 to about 5:1.

13. An emulsified detergent composition according to claim 10 wherein the pH is from about 7.5 to about 8.5.

14. An emulsified detergent composition, comprising:

(a) from about 25% to about 35% by weight of a $C_{10-12}$ ethoxylated fatty alcohol having at least about 4 ethylene oxide units per mole;

(b) from about 0.005% to about 4% by weight of an ethoxylated amine selected from the group consisting of ethoxylated monoamines, ethoxylated diamines, ethoxylated polyamines and mixtures thereof;

(c) from about 0.01% to about 2% by weight of polyethylene glycol;

(d) from about 0.1% to about 0.5% by weight of protease enzyme;

(e) from about 5% to about 25% of hydrocarbon;

(f) from about 0.1% to about 5% of an electrolyte; and (g) the balance water;

whereby the cloud point of the detergent composition is from about −10° C. to about 20° C. and the detersive surfactant and the water are in two separate phases in a weight ratio of about 1:7 to about 2:1 in the detergent composition.

15. A method of laundering soiled fabrics comprising the step of contacting said fabrics with an effective amount of a detergent composition according to claim 1 in an aqueous laundering solution.

16. A method of pretreating soiled fabrics comprising the step of contacting said fabrics with an effective amount of a detergent composition according to claim 1 prior to laundering said fabrics.

17. A method of laundering soiled fabrics comprising the step of contacting said fabrics with an effective amount of a detergent composition according to claim 10 in an aqueous laundering solution.

18. A method of pretreating soiled fabrics comprising the step of contacting said fabrics with an effective amount of a detergent composition according to claim 10 prior to laundering said fabrics.

* * * * *